US007525508B2

(12) United States Patent
Sharaiha et al.

(10) Patent No.: US 7,525,508 B2
(45) Date of Patent: Apr. 28, 2009

(54) BROADBAND HELICAL ANTENNA

(75) Inventors: Ala Sharaiha, Rennes (FR); Yoann Letestu, Le Hingle (FR); Jean-Christophe Louvigne, Rennes (FR)

(73) Assignee: Universite de Rennes 1, Rennes (FR)

( * ) Notice: Subject to any disclaimer, the term of this patent is extended or adjusted under 35 U.S.C. 154(b) by 354 days.

(21) Appl. No.: 10/528,516

(22) PCT Filed: Sep. 19, 2003

(86) PCT No.: PCT/FR03/02774

§ 371 (c)(1),
(2), (4) Date: Jan. 17, 2006

(87) PCT Pub. No.: WO2004/027930

PCT Pub. Date: Apr. 1, 2004

(65) Prior Publication Data

US 2006/0125712 A1 Jun. 15, 2006

(30) Foreign Application Priority Data

Sep. 20, 2002 (FR) ..... 02 11696

(51) Int. Cl.
*H01Q 1/36* (2006.01)
*H01Q 1/38* (2006.01)

(52) U.S. Cl. ..... 343/895; 343/700 MS; 343/853

(58) Field of Classification Search ..... 343/895
See application file for complete search history.

(56) References Cited

U.S. PATENT DOCUMENTS

| | | | | |
|---|---|---|---|---|
| 5,838,285 | A * | 11/1998 | Tay et al. | 343/895 |
| 5,986,619 | A * | 11/1999 | Grybos et al. | 343/895 |
| 5,990,847 | A * | 11/1999 | Filipovic et al. | 343/895 |
| 6,160,516 | A | 12/2000 | Teran et al. | 343/702 |
| 6,229,499 | B1 | 5/2001 | Licul et al. | 343/895 |
| 6,278,414 | B1 | 8/2001 | Filipovic | 343/895 |
| 6,421,026 | B2 * | 7/2002 | Nishino et al. | 343/860 |
| 6,836,257 | B2 * | 12/2004 | Louvigne et al. | 343/895 |

FOREIGN PATENT DOCUMENTS

| | | |
|---|---|---|
| EP | 1 154 519 A1 | 11/2001 |
| FR | 5 654 554 | 11/1989 |
| FR | 2 746 547 | 3/1996 |
| FR | 2 814 285 | 9/2000 |

(Continued)

OTHER PUBLICATIONS

J.C. Louvigne et al., "Broadband Tapered Printed Quadrifilar Helical Antenna", Electronics Letterw, IEE 2001, vol. 37, No. 15, pp. 249-255.

(Continued)

*Primary Examiner*—Trinh V Dinh
(74) *Attorney, Agent, or Firm*—Westman, Champlin & Kelly, P.A.

(57) ABSTRACT

A helical antenna comprising at least one helix which is formed by at least two radiating wires. According to the invention, at least one of said radiating wires is associated with a parasitic wire having a width which is less than or equal to the radiating wire(s), such as to broaden the bandwidth of the antenna.

13 Claims, 8 Drawing Sheets

FOREIGN PATENT DOCUMENTS

| | | |
|---|---|---|
| FR | 2 814 286 | 9/2000 |
| WO | WO 96/34425 | 9/1995 |

OTHER PUBLICATIONS

H. Feldman, "An Introduction to Immarasat's New Mobile Nultimedia Service", Sixth International Mobile Satellite Conference, Jun. 1999, pp. 266-229.

A. Sharaiha, "Analysis of Quadrifilar Resonant Printed Helical Antenna for Mobile Communications", Iee Proceedings-H, vol. 140, No. 4, Aug. 1993, pp. 269-273.

J.V. Evans, Satellite Systems for Personal Communication, IEEE Antennas and Propagation Magazine, vol. 39, No. 3, Jun. 1997, pp. 7-20.

* cited by examiner

PRIOR ART

BROADBAND HELICAL ANTENNA

CROSS-REFERENCE TO RELATED APPLICATION

This Application is a Section 371 National Stage Application of International Application No. PCT/FR2003/02774, filed Sep. 19, 2003 and published as WO 2004/027930 A1 on Apr. 1, 2004, not in English, which is based on French Application No. 02 11696, filed Sept. 20, 2002, the contents of which is hereby incorporated by reference in its entirety.

FIELD OF INVENTION

The field of the invention is that of broadband antennas and antennas with a hemispherical or near-hemispherical radiation pattern. More specifically, the invention relates to helical antennas of this type.

BACKGROUND OF THE INVENTION

The antenna of the invention has applications in particular in the context of mobile satellite communication between stationary users and/or mobile telephones of any type, for example, aeronautical, seaborne or terrestrial. In this field, several satellite communication systems are implemented, or are currently being developed (for example, INMARSAT, INMARSAT-M, GLOBALSTAR systems (registered trademarks), and so on). These antennas are also useful in the deployment of personal communication systems (PCS) by geostationary satellites.

The objective of these systems is to provide terrestrial users with new communications services (multimedia, telephone) via the satellites. Using geostationary or moving satellites, they enable global terrestrial coverage to be obtained. They must be similar to terrestrial cellular systems in terms of cost, performance and size. Thus, the antenna located on the user's terminal is a key element from the point of view of size reduction.

Such systems are described in particular in the documents of Howard Feldman, D. V. Ramana: "An introduction to Inmarsat's new mobile multimedia service", Sixth International Mobile Satellite Conference, Ottawa, June 1999, and J. V. Evans: "Satellite systems for personal communications", IEEE A-P Magazine, Vol. 39, no. 3, June 1997.

For all of these systems, which provide connections with geostationary satellites, the very different incidences of the signals received or transmitted require antennas to have an hemispherical or near-hemispherical coverage radiation pattern. In addition, the polarisation must be circular (left or right) with a ratio below 5 dB in the useful band.

More generally, the invention may have applications in all systems requiring the use of a broadband and a circular polarisation.

In these various fields of application, the antennas must indeed have the aforementioned features either in a very broad band of approximately 10% or more, or in two adjacent sub-bands corresponding to the reception and the transmission, respectively.

A type of quadrifilar helical antenna particularly suitable for such applications is already known from patent document FR-8914952 of France Telecom (registered trademark). A quadrifilar antenna is made of four radiating wires.

This antenna, referred to as a printed quadrifilar helical (PQH) antenna, has features similar to those mentioned, in a frequency band limited in general to 6 or 8% for an SWR below two.

A broader band operation can be obtained using two-layer PQH antennas. These antennas are formed by the concentric "interleaving" of two coaxial quadrifilar resonant helices which are electromagnetically coupled. The assembly functions as two coupled resonant circuits, of which the coupling deflects the resonance frequencies. Thus, a two-layer quadrifilar resonant helical antenna is obtained according to the technique described in FR-8914952.

This technique has the advantage of requiring a single power supply system, and of enabling double- or broadband operation.

However, it has the disadvantage of requiring two printed and overlapping circuits to be produced, and, in the double-band operation, of providing only a narrow band in each sub-band. In broadband operation, the bandwidth obtained remains limited.

Another embodiment is described in detail in the document "Analysis of quadrifilar resonant helical antenna for mobile communications", by A. Sharaiha and C. Terret (IEE—Proceedings H, vol. 140, no. 4, August 1993).

According to this embodiment, the radiating wires are printed on a thin dielectric substrate, then wound around a transparent cylindrical support with radioelectric transparency. The four helical wires are opened or short-circuited at one end, and electrically connected at the other end.

This antenna requires a power supply circuit that provides the excitation of the different antenna wires by signals of the same amplitude in phase quadrature. This function can be achieved using 3 dB −90° coupling structures and a hybrid ring. The assembly can be placed in a printed circuit and positioned at the antenna base. A simple yet bulky power supply is thus obtained.

As mentioned above, it is desirable for the antenna (including its power supply) to be of the smallest possible size and lowest possible weight, and to have the lowest possible cost.

Several approaches which seek to reduce the size of the antenna and its power supply system have been proposed. In particular, as examples, the following solutions can be cited:

- in patent document FR-9603698, of France Telecom (helical antenna with integrated broadband power supply);
- in patent document FR-0011830, of France Telecom (helical antenna with adjustable pitch);
- in patent document FR-0011843, of France Telecom (helical antenna with wires of adjustable width); and
- in the article of B. Desplanches, A. Sharaiha and C. Terret entitled "Parametrical study of printed quadrifilar helical antennas with central dielectric rods" (Microwave and Opt. Technol. Letters, vol. 20, no. 4, Feb. 20, 1999).

Nevertheless, these antennas do not have a very large bandwidth.

The prior art also describes helical antennas with bent radiating elements shown respectively in a patent document U.S. Pat. No. 6,229,499 of the XM Satellite Radio company (registered trademark) and in a patent document U.S. Pat. No. 6,278,414 of the Qualcomm company (registered trademark). These antennas have radiating elements which are partially bent onto themselves thus enabling their height to be reduced. Nevertheless, these antennas have the disadvantage of having a narrow bandwidth.

The aim of the invention is in particular to overcome these various disadvantages of the prior art.

SUMMARY OF THE INVENTION

More specifically, an aim of the invention is to produce a resonant helical antenna with a broad band, capable of covering, for example, the transmission band and the reception band of a communication system.

In particular, and aim of the invention is to produce such a helical antenna having a large bandwidth (greater than that obtained in the prior art) in each sub-band, when two sub-bands are provided.

Another aim of the invention is to produce such an antenna of which the size, performance and production cost are acceptable for portable terminals of terrestrial cellular systems.

Another aim of the invention is to produce an antenna of reduced size that has a broadband operation.

Another aim of the invention is to provide an antenna that is relatively simple to produce, and which is therefore inexpensive.

Yet another aim of the invention is to provide an alternative technique to the solutions of the prior art.

These aims, as well as others described below, are achieved according to) the invention by a helical antenna including at least one helix formed by at least two radiating wires, with at least one of the radiating wires being associated with a parasitic wire which is narrower than or equal in width to the radiating wires so as to enlarge the bandwidth of the antenna.

Preferably, the helical antenna is remarkably in that each of the parasitic wires is connected to the ground.

Thus, the operation of the antenna, and in particular of the parasitic wires, is optimized.

According to a specific feature, the helical antenna is remarkable in that the radiating wires and the parasitic wires are printed on a substrate.

In this way, the helical antenna can be made according to a production mode that is simple, effective and inexpensive.

According to a preferred feature, the antenna is remarkable in that each of the radiating wires is associated with a parasitic wire which is narrower than or equal in width to the radiating wire.

Thus, an inductive behaviour (corresponding to a radiating wire and in particular its length) associated with an overall capacitive behaviour (corresponding to the association between a radiating wire and a parasitic wire and dependent on the distance between said two wires and the ratio between their widths) is obtained, with the parasitic wire being preferably narrower.

According to a specific feature, the helical antenna is remarkable in that the ratio between the width of each of the parasitic wires and the width of the associated radiating wire is less than or equal to 0.15.

Thus, the performance of the antenna is optimal, in particular in the adjacent bands of 1 GHz.

The helical antenna is preferably remarkable in that each of the parasitic wires is positioned with respect to the associated radiating wire so as to optimise the coupling between the parasitic wire and the associated radiating wire.

Thus, a parasitic wire and the associated radiating wire are positioned so as to optimise the bandwidth, with an optimum coupling being, if it exists, dependent on the distance separating them.

Thus, the antenna has improved matching.

According to a specific feature, the helical antenna is remarkable in that each of the parasitic wires is farther from the associated radiating wire than from at least one of the other radiating wires.

Indeed, an optimisation of the coupling between the parasitic wire and the associated radiating wire is often obtained by distancing the parasitic wire from the associated radiating wire; thus, the farther the parasitic wire and the associated radiating wire are from each other, the broader the radiating band of the antenna is.

According to a specific feature, the helical antenna is remarkable in that each of the parasitic wires is parallel to the radiating wire with which it is associated.

In this case, when a parasitic wire and the associated radiating wire are rectilinear and of a constant or variable width, the two wires are parallel if their middle longitudinal lines are parallel.

In this case, when a parasitic wire and/or the associated radiating wire form a broken line, the two wires are considered to be parallel if one of the following three conditions is satisfied:

- their middle longitudinal lines are parallel;
- their external and/or internal tangents in the lengthwise direction are parallel; or
- each of the segments forming the parasitic wire is parallel to an associated segment of the radiating wire.

Thus, each of the parasitic wires and the associated radiating wires have a capacitive effect.

According to a specific feature, the helical antenna is remarkable in that each of the parasitic wires has substantially the same length as the radiating wire with which it is associated.

Thus, the antenna is relatively simple to produce (and in particular simpler than if the one end of the parasitic wire were connected to the ground, for example, in the centre of the cylinder).

According to a specific feature, the helical antenna is remarkable in that one of the ends of each of the radiating wires is connected by a conductive connection to one of the ends of the radiating wire with which the parasitic wire is associated.

Thus, the parasitic wires and the associated radiating wires can be etched on the same side of the substrate, leaving the other side of the substrate available for another use (for example, for etching additional wires or another helical antenna).

According to a specific feature, the helical antenna is remarkable in that one of the ends of each of the radiating wires is connected by coupling to one of the ends of the radiating wire with which the parasitic wire is associated.

According to a specific feature, the helical antenna is remarkable in that the radiating wires are printed on a first surface of a substrate and in that the parasitic wires are printed on a second surface of the substrate.

Thus, the production of the antenna is simplified since the power supply (in particular connected to a radiating wire) and the ground (connected to a parasitic wire) are not necessarily present on the same side of the substrate. Plated through-holes enabling the ground to pass through on the side of the power supply, therefore, are not essential.

According to a specific feature, the helical antenna is remarkable in that at least one parasitic wire and a radiating wire adjacent to the radiating wire with which the parasitic wire is associated cross over one another.

Thus, the distance between a parasitic wire and the associated radiating wire is greater than that separating two adjacent radiating wires. This in particular provides a wider margin for adjusting the coupling between a parasitic wire and the associated radiating wire, and therefore makes it easier to find an optimal solution for improving the bandwidth.

According to a specific feature, the helical antenna is remarkable in that the end of the radiating wires not associated with a parasitic wire is connected to a feedline of a power supply circuit.

The operation of the antenna is thus optimised.

According to a specific feature, the helical antenna is remarkable in that at least one of the helices is a quadrifilar helix, consisting of four wires.

In this way, a pure circular polarisation is obtained.

In addition, in some cases, the opening of the antenna is very wide, with the radiation pattern being nearly hemispherical.

According to a specific feature, the helical antenna is remarkable in that the radiating wires forming a helix are all the same size and in that the parasitic wires are all the same size.

Thus, an improved circular polarisation is obtained, with good symmetry of the wires. Moreover, the wires have the same phase-shifted current distribution of 90°.

According to a specific feature, the helical antenna is remarkable in that at least one of the radiating and/or parasitic wires is formed by at least two segments, with the angles of wrap of at least two of the segments being different and determined randomly or pseudo-randomly using global optimisation means.

Thus, the line formed by each of the radiating and/or parasitic wires is broken, thereby enabling the size of the antenna to be reduced while maintaining a high level of performance.

According to a specific feature, the helical antenna is remarkable in that at least one of the radiating and/or parasitic wires has a variable width, varying regularly and consistently between a maximum and a minimum width.

In this way, the matching of the antenna is simplified, with an additional adjustment parameter available for this matching.

According to a specific feature, the helical antenna is remarkable in that the radiating wires have a length substantially different from a multiple of the wavelength corresponding to the mean frequency of the transmission band of the antenna, divided by 4.

Thus, the opening of the antenna can be used, unlike in the known dipole antennas with a parasitic wire, which have a multiple length of $\lambda/4$ where $\lambda$ represents the transmission wavelength of the antenna.

Other features and advantages of the invention will appear more clearly as a preferred embodiment of the invention is described, given as a simple, non-limiting example, with appended drawings.

DETAILED DESCRIPTION OF THE PREFERRED EMBODIMENTS

Figure 1:
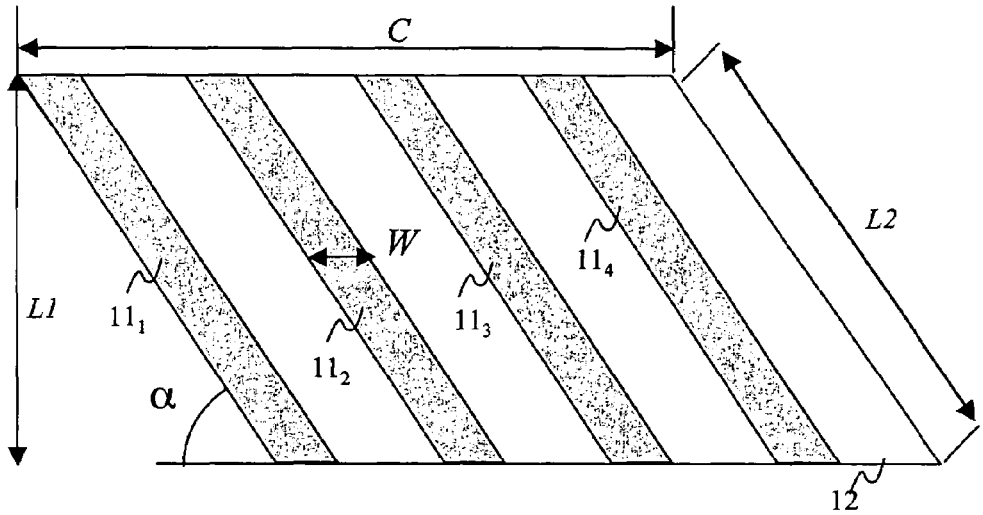
Fig. 1 PRIOR ART
FIGS. 1 and 2 show a known quadrifilar helical antenna with conventional wires of uniform width, when the helix is developed (FIG. 1) and when it is wound around a cylindrical support (FIG. 2), respectively.
Figure 2:
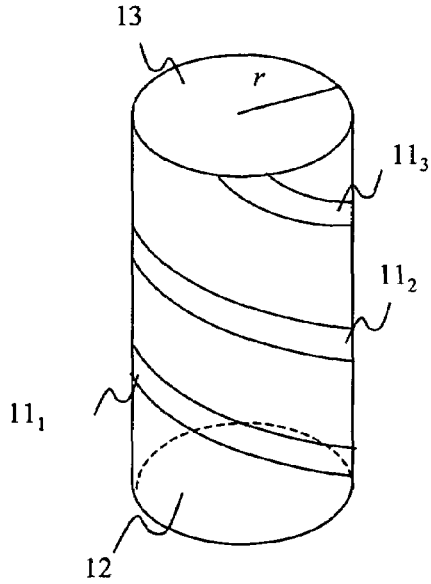

FIGS. 1 and 2 show a conventional quadrifilar helical antenna, as already discussed previously. It includes four wires $\mathbf{11}_1$ to $\mathbf{11}_4$ of length L2 and width d. These radiating wires are printed on a thin dielectric substrate 12 which is then wound around a cylindrical support 13 with radioelectric transparency, or radius r, circumference c and axial length L1, and $\alpha$ being the angle of wrap.

Conventionally, the antenna requires a power supply circuit that provides the excitation of the different wires by signals of the same amplitude and in phase quadrature. This function can be achieved using 3 dB −90° coupling structures and a hybrid ring, produced in a printed circuit and positioned at the antenna base.

Figure 3:
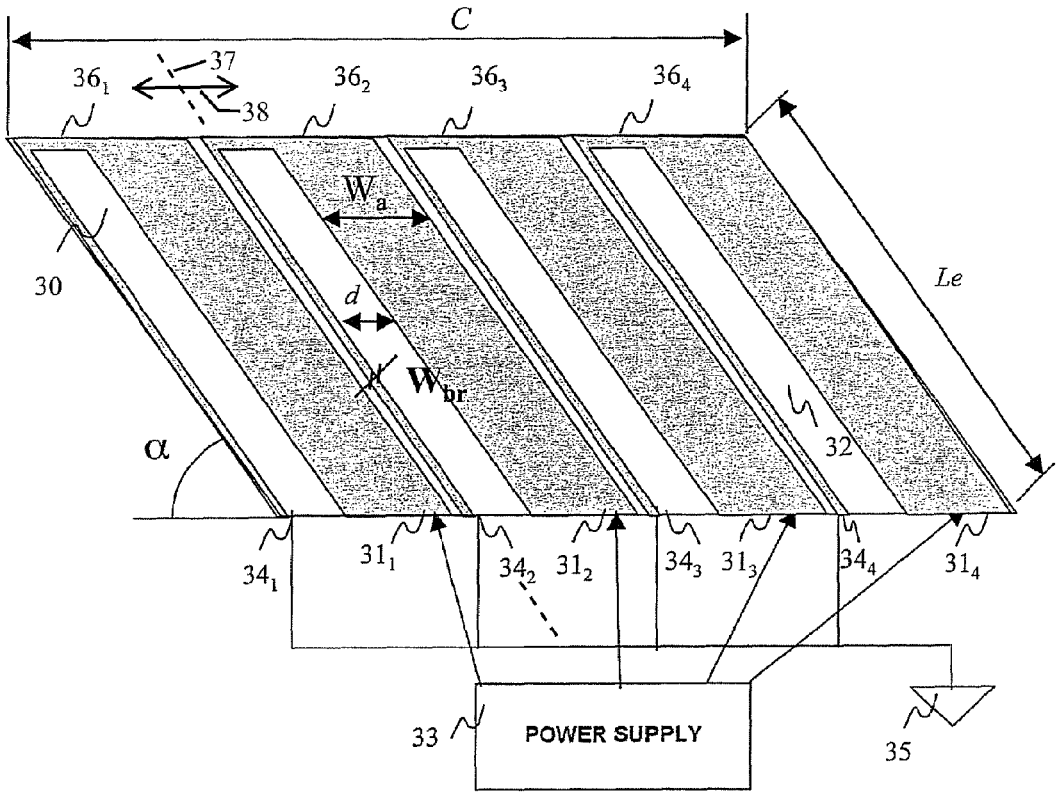
FIG. 3 is an example of a helix according to the invention, in its developed form.

FIG. 3 shows an example of a helix 30 according to the invention, in its developed form. The PQH antenna 30 therefore comprises 4 conductive radiating wires $\mathbf{31}_1$ to $\mathbf{31}_4$ which are regularly spaced, printed on a substrate 32 and with a width equal to $W_a$. The four wires $\mathbf{31}_1$ to $\mathbf{31}_4$ are bend onto themselves at one of their ends $\mathbf{36}_1$ to $\mathbf{36}_4$, respectively, each forming a parasitic wire $\mathbf{34}_1$ to $\mathbf{34}_4$, respectively, and connected to the other end at the feedline of the power supply circuit 33. Each parasitic wire $\mathbf{34}_1$ to $\mathbf{34}_4$ has an axis 37. Arrow 38 represents a direction perpendicular to axis 37.

The parasitic wires $\mathbf{34}_1$ to $\mathbf{34}_4$ have a width $W_{br}$ narrower than the width $W_a$ of the radiating wires so as to ensure the broadband operation of the antenna. The parasitic wires $\mathbf{34}_1$ to $\mathbf{34}_4$ are connected to the ground 35 at the opposite end $\mathbf{36}_1$ to $\mathbf{36}_4$, respectively. In the embodiment described with respect to FIG. 3, the width $W_{br}$ of the parasitic wires and the width $W_a$ of the radiating wires are constant.

Figure 4:
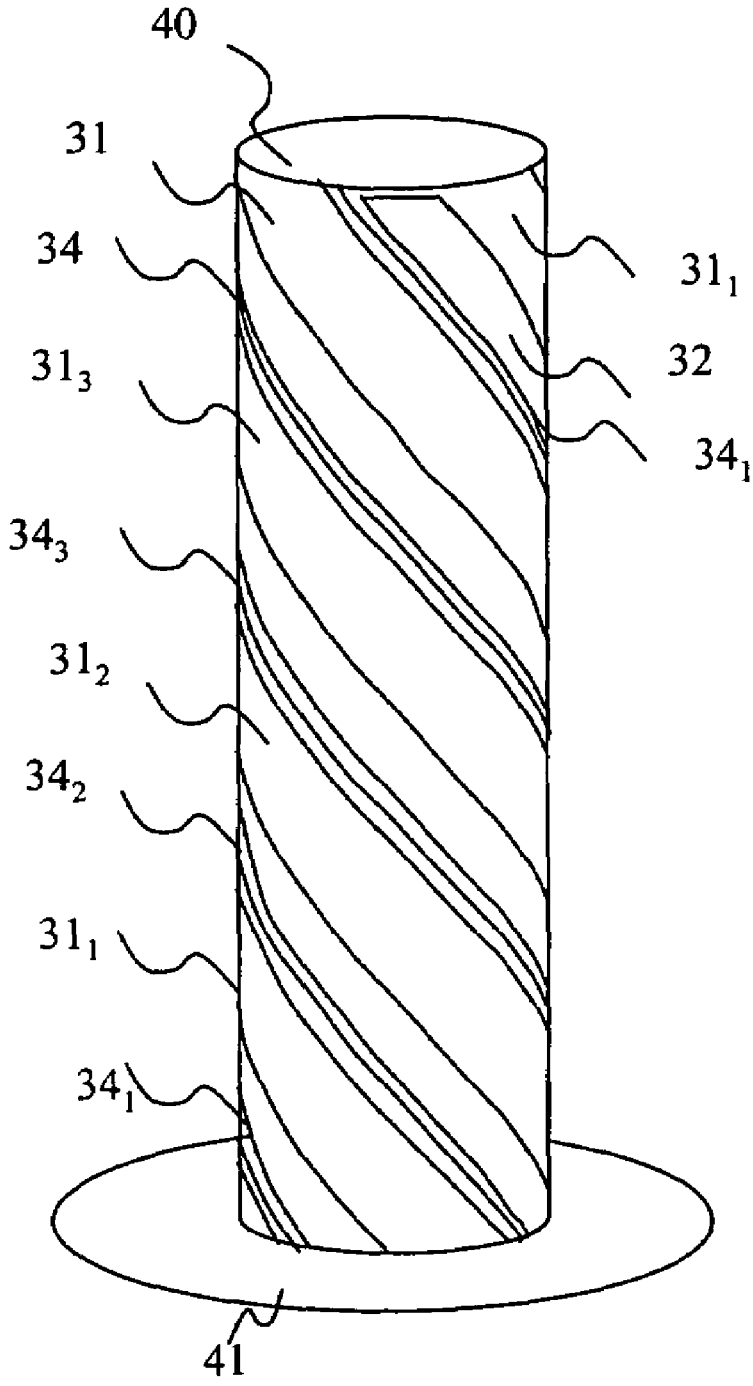
FIG. 4 shows a frontal view of the helix of FIG. 3, wound around its cylindrical support

The antenna 30 is then wound around a cylindrical support, as shown in FIG. 4, which shows a frontal view of the antenna wound around its cylindrical support.

Now a specific embodiment of the invention will be described in detail. Of course, it is only a single example, and many variations and adaptations are possible, depending on the needs and uses.

The antenna produced and shown in FIGS. 3 and 4 has the following features:

Length of wires: $0.83\lambda$ where $\lambda$ represents the wavelength corresponding to the mean frequency of the transmission band (this length having been selected to optimise the opening of the antenna);

Diameter: $0.18\lambda$;

Distance d: 9 mm;

Width $W_{br}$: 1.95 mm;

Ratio of wire widths $W_a/W_{br}$: 8.

Angle of wrap, $\alpha$: 50°.

Generally, the band of the antenna becomes broader when the distance d is increased. Preferably, the parasitic wire is therefore close to the adjacent radiating wire.

Generally, there is an optimal bandwidth depending on the distance between a parasitic wire and the associated radiating wire.

Figure 5:
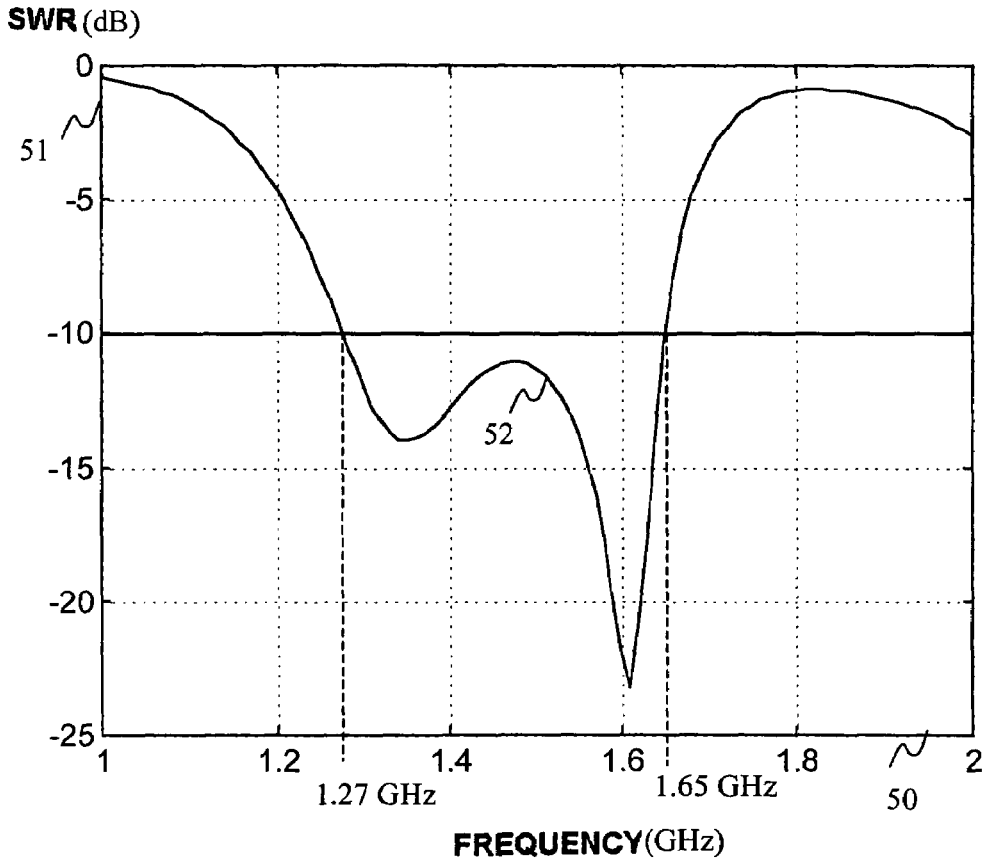
FIG. 5 shows an example of SWR measured at the input of a wire for an antenna according to the invention.

FIG. 5 shows the SWR 52 measured as a function of the frequency 50 (expressed in GHz in the figure) measured at the input of a radiating wire for the antenna 30 shown in FIGS. 3 and 4, with the others being charged under 50 Ω.

The antennas are measured at the central frequency F1 equal to 1.5 GHz.

It is noted that for the PQH antenna with a bent wire according to the invention, matching of the PQH antenna below −10 dB is achieved on the interval ranging from 1.27 GHz to 1.65 GHz, i.e. a bandwidth that reaches 26%. Thus, the PQH antenna has a significant increase in bandwidth. Indeed, this is a increase from a bandwidth of approximately 6 to 8% for a conventional PQH antenna to a bandwidth of approximately 26% for an antenna as shown in FIGS. 3 and 4.

Thus, the printed bent quadrifilar antenna of which each parasitic wire is connected to the ground enables transmission and/or reception in a broad bandwidth or in two different sub-bands each having a broad bandwidth.

The technique of the invention therefore results in a significant increase in the bandwidth. Thus, a printed quadrifilar helical antenna operating in a broad bandwidth and/or in two different sub-bands each having a broad bandwidth, of reduced height, is obtained. The printed bent quadrifilar helical antenna with parasitic wires connected to the ground therefore enables an increase in the bandwidth of the antenna without any reduction in the length of the wires.

Figure 6:
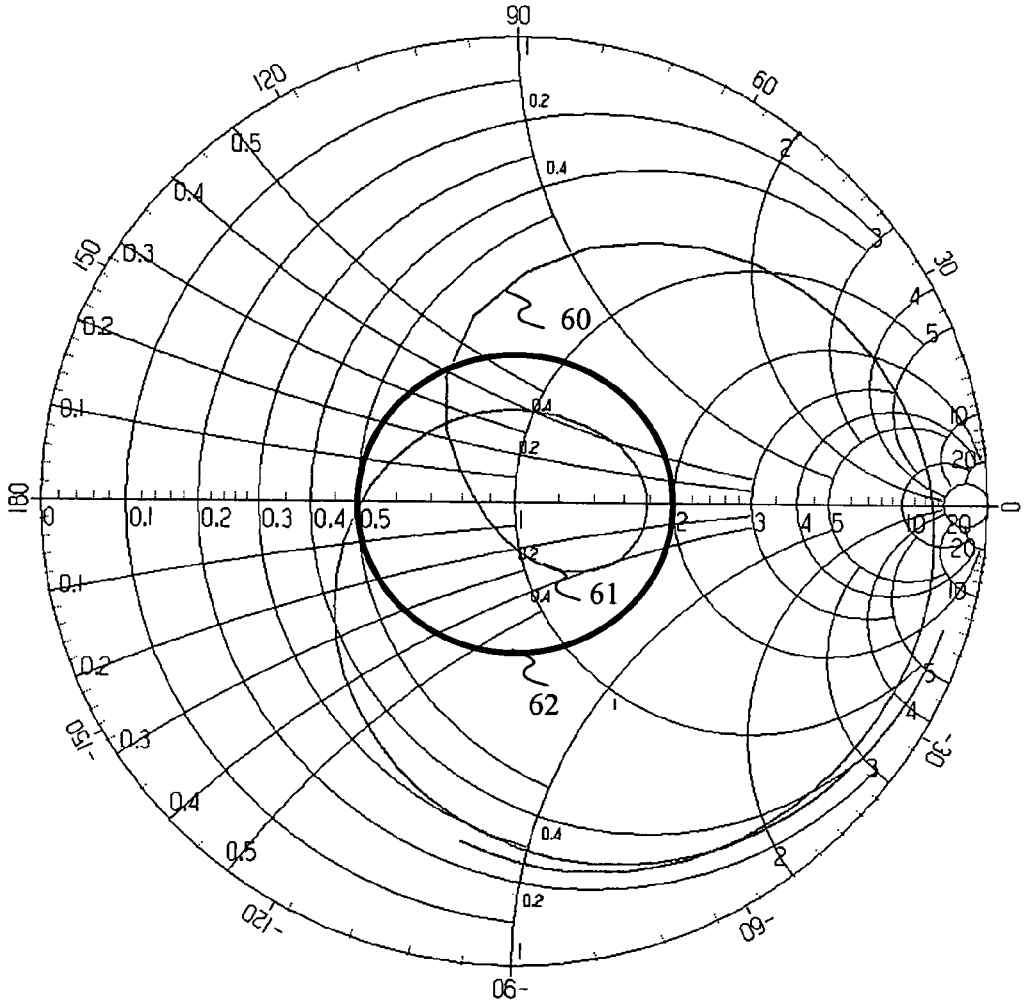
FIG. 6 is a Smith chart representing the input impedance of an antenna according to the invention.

FIG. 6 is a Smith chart showing the input impedance 60 of an antenna according to the invention normalised at 50 Ohms.

A loop 61 on the curve 60 is a result of the coupling and yields the broad band since it is present inside a circle 62 corresponding to an SWR below or equal to 2.

Figure 7A:
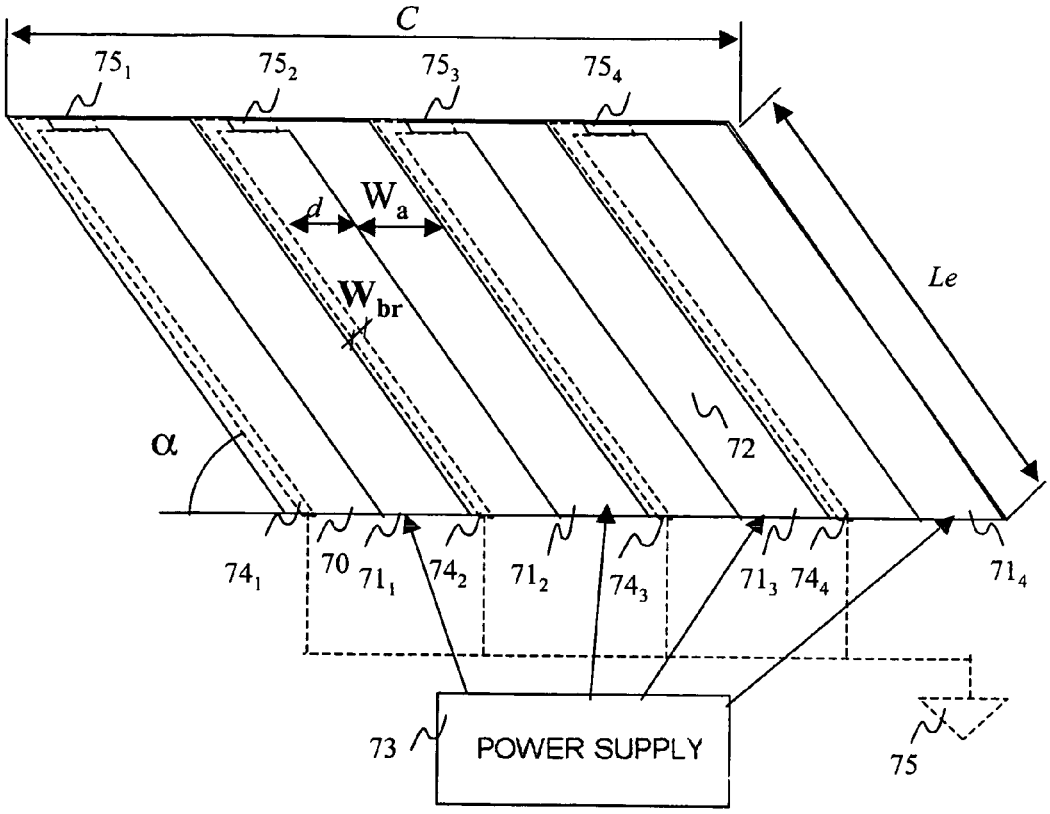
FIGS. 7*a* and 7*b* show an embodiment of the invention in which the radiating wires and the associated parasitic wires are coupled while being printed on two opposite sides of a substrate.

FIG. 7*a* shows an example of a helix 70 according to an embodiment of the invention, in its developed form. The PQH antenna 70 therefore comprises 4 conductive radiating wires $\mathbf{71}_1$ to $\mathbf{71}_4$ which are regularly spaced, printed on a first surface of the substrate 72 and with a width equal to $W_a$. The four wires $\mathbf{71}_1$ to $\mathbf{71}_4$ are connected at one of their ends to the feedlines of the power supply circuit 73.

Parasitic wires $\mathbf{74}_1$ to $\mathbf{74}_4$ (shown with dotted lines) are printed parallel to the radiating wires on a second surface of the substrate 72 opposite the first surface. The parasitic wires $\mathbf{74}_1$ to $\mathbf{74}_4$ are connected to the ground 75 at one of their ends $\mathbf{71}_1$ to $\mathbf{71}_4$, respectively.

Each of the parasitic wires $\mathbf{74}_1$ to $\mathbf{74}_4$ is coupled by its end $\mathbf{75}_1$ to $\mathbf{75}_4$ not connected to the ground 75, to the end not connected to the power supply of the wire $\mathbf{71}_1$ to $\mathbf{71}_4$ with which it is associated. The parasitic wires $\mathbf{74}_1$ to $\mathbf{74}_4$ have a width $W_{br}$ narrower than or equal to, and preferably much narrower (in a ratio $W_{br}/W_a$ of less than 0.15) than the width $W_a$ of the radiating wires so as to ensure the broadband operation of the antenna. In the embodiment described with respect to FIGS. 7*a* and 7*b*, the width of the parasitic wires $W_{br}$ and the width $W_a$ of the radiating wires are constant.

In this case, the distance separating a parasitic wire and the associated radiating wire is not limited by the distance separating two radiating wires. Thus, the distance between a parasitic wire and the radiating wire can be greater than the distance separating two radiating wires. The coupling between a parasitic wire and the associated radiating wire, and therefore the bandwidth, can thus be improved. There are more possibilities in the search for the optimum coupling.

Figure 7B:
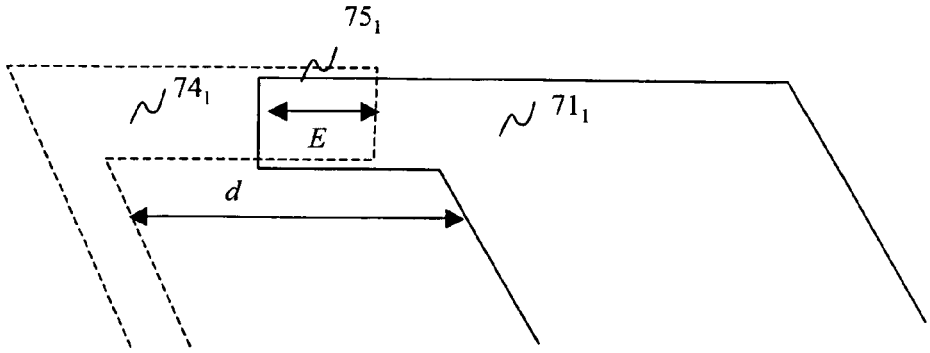

FIG. 7*b* shows in detail the end 751 of the radiating wire 711 coupled to the parasitic wire 741. Generally, each of the parasitic wires and the associated radiating wire cross over one another on each side of the substrate 72 over a distance E between 0 and the distance d separating the parasitic wire and the associated radiating wire.

Since the other features of the antenna 70 (winding around a cylindrical support, size of wires and the antenna . . . ) are similar to those of the antenna 30 of FIGS. 3 and 4, they will not be further described.

Figure 8:
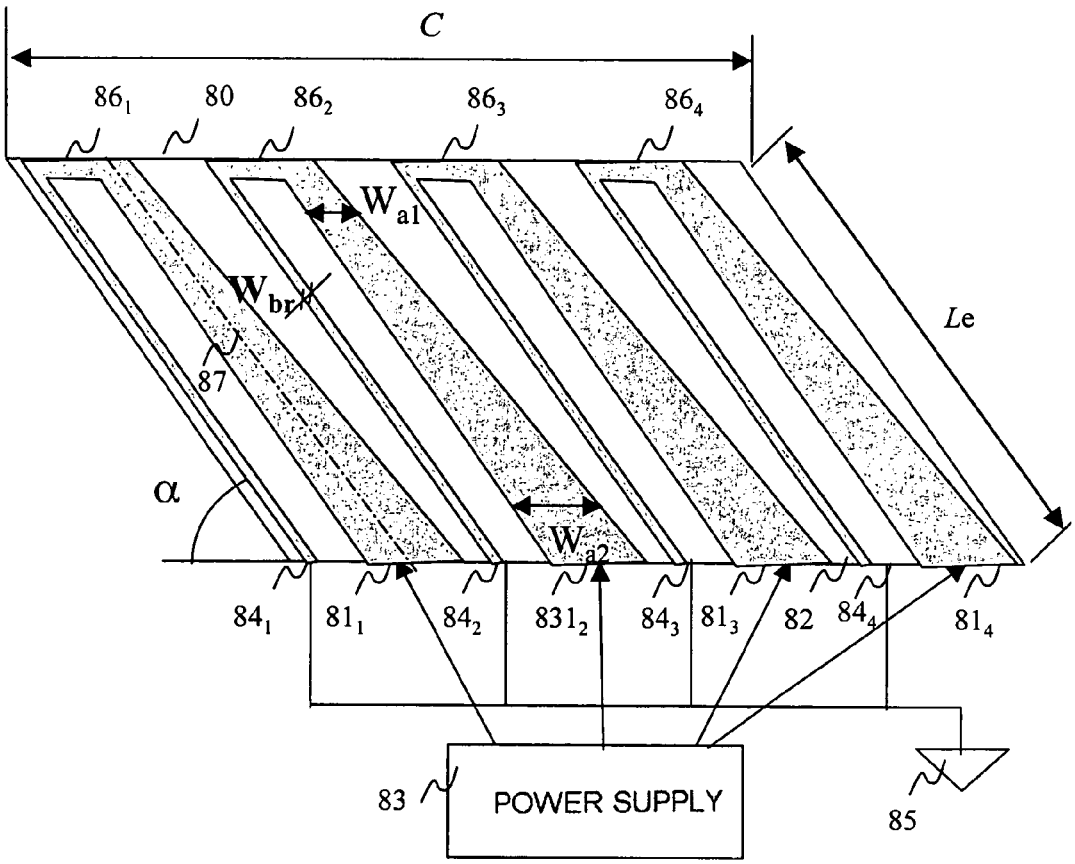
FIG. 8 shows an example of an antenna according to an embodiment of the invention in which the radiating wires have a variable width.

FIG. 8 shows an example of an antenna 80 according to an embodiment of the invention in which the radiating wires $\mathbf{81}_1$ to $\mathbf{81}_4$ have a variable width. Each of the radiating wires $\mathbf{81}_1$ to $\mathbf{81}_4$ is connected by one of its ends to a parasitic wire $\mathbf{84}_1$ to $\mathbf{84}_4$.

The objective of this embodiment is in particular to obtain a PQH antenna 80 enabling the bandwidth to be further broadened and/or the matching of the antenna 80 to be improved (the variation in the bandwidth being an additional parameter that can be used for matching). This is obtained by varying the width of the radiating wires along the helix. Thus, the extremities of the radiating wires have a different width $W_{a1}$ and $W_{a2}$, respectively. The variation in width can be:

regular, in a linear, exponential, double exponential, step-like pattern . . . or irregular.

Preferably, the width of parasitic wires is constant and each of the parasitic wires is parallel to a middle longitudinal line of the associated radiating wire (shown, for example, by line 87 corresponding to the wire $\mathbf{81}_1$).

As an example, each of the radiating wires of the antenna 80 has a minimum width $W_{a1}$ equal to 2 mm and a maximum width $W_{a2}$ equal to 16 mm.

With the exception of the width of the radiating wires, since the features of the antenna 80 are similar to those of the antenna 30 shown in FIGS. 3 and 4, they will not be further described.

According to an embodiment of the invention which is not shown, the parasitic wires of a helical antenna are coupled and not directly connected to the radiating wires of variable width, similar to the wires $\mathbf{81}_1$ to $\mathbf{81}_4$ of the antenna 80 (according to a coupling similar to that of the radiating and parasitic wires of the antenna 70).

According to another embodiment of the invention, the width of the parasitic wires is variable, and the middle longitudinal lines of each of the parasitic wires and the associated radiating wire are parallel.

According to yet another embodiment which is not shown, the parasitic wires are parallel to one of the sides of the radiating wires. A parasitic wire parallel to an adjacent radiating wire enables, in particular said parasitic wire to be distanced from the associated radiating wire while bringing it closer to the adjacent wire, thus increasing the capacitive effect and the bandwidth of the antenna.

Generally, parasitic wires and radiating wires are connected at a single point.

Figure 9A:
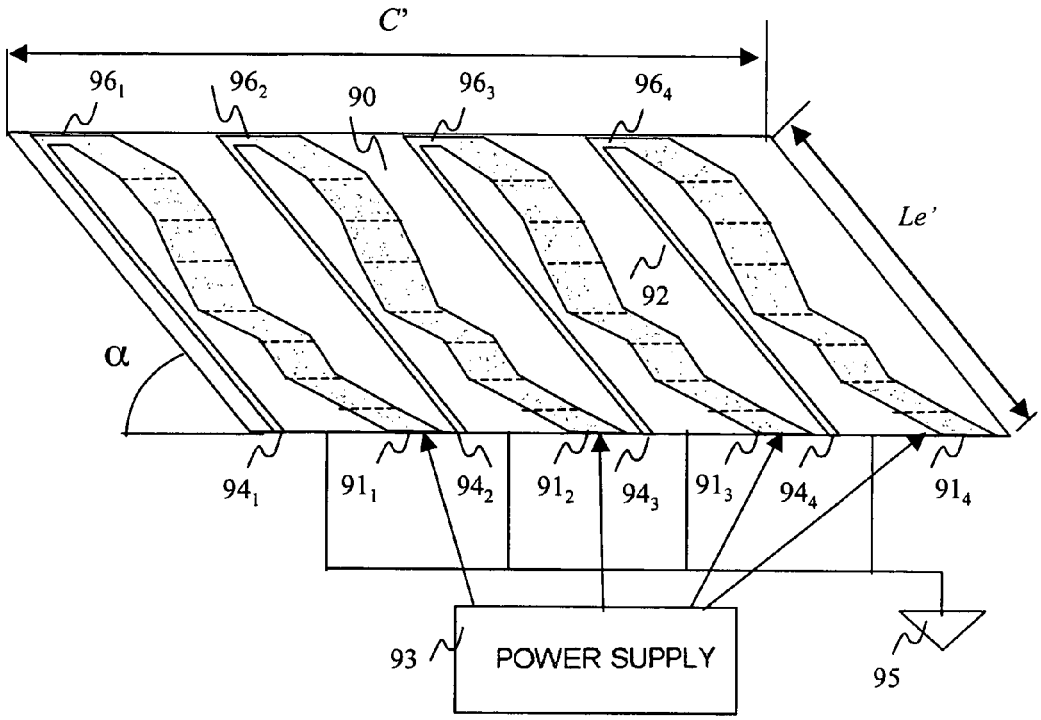
FIGS. 9*a* and 9*b* show an example of an antenna according to another embodiment of the invention in which radiating wires form a broken line.

FIG. 9*a* shows an example of an antenna 90 according to another embodiment of the invention in which radiating wires $\mathbf{91}_1$ to $\mathbf{91}_4$ form a broken line.

Each radiating wire $\mathbf{91}_1$ to $\mathbf{91}_4$ is connected by one of its ends to a parasitic wire $\mathbf{94}_1$ to $\mathbf{94}_4$.

Each radiating wire $\mathbf{91}_1$ to $\mathbf{91}_4$ (or at least some) of the PQH antenna is divided into a limited number of segments. According to the mathematical expressions associating the geometric parameters of a helical antenna, it is noted that a modification to the angle of wrap affects the pitch of the antenna, and therefore its axial length.

It is thus possible to give a different angle of wrap for each segment. The height can thus be reduced. Introducing different angles of wrap can be equated with a change in the pitch of the antenna.

However, the angle of wrap a is also a parameter affecting the radiation pattern of a PQH antenna (opening angle at 3 dB, ellipticity ratio). Therefore, to select the appropriate different angles $\alpha$, a global optimisation program such as simulated annealing or the genetic algorithm can be used.

The synthesis is performed on principally- and cross-polarized radiation patterns by introducing a template defined by the desired levels of amplitude and −3 dB opening angles.

The placement of this template enables perfect control of the opening angles at −3 dB, as well as the rejection of reverse polarisation, and therefore the ellipticity ratio. The variables to be optimised are the different angles of wrap of the PQH antenna wires. The algorithm will give the optimum angles $\alpha_1$.

Each radiating wire $\mathbf{91}_1$ to $\mathbf{91}_4$ of the antenna 90 shown in FIG. 9*a* is divided, for example, into eight identical segments of length L. The angles of wrap corresponding to each of the eight segments of the radiating wires of the antenna 90 are as follows:

$\alpha_1$=30°;
$\alpha_2$=33°;
$\alpha_3$=55°;
$\alpha_4$=34°;
$\alpha_5$=65°;
$\alpha_6$=68°;
$\alpha_7$=54°; and
$\alpha_8$=33°.

Figure 9B:
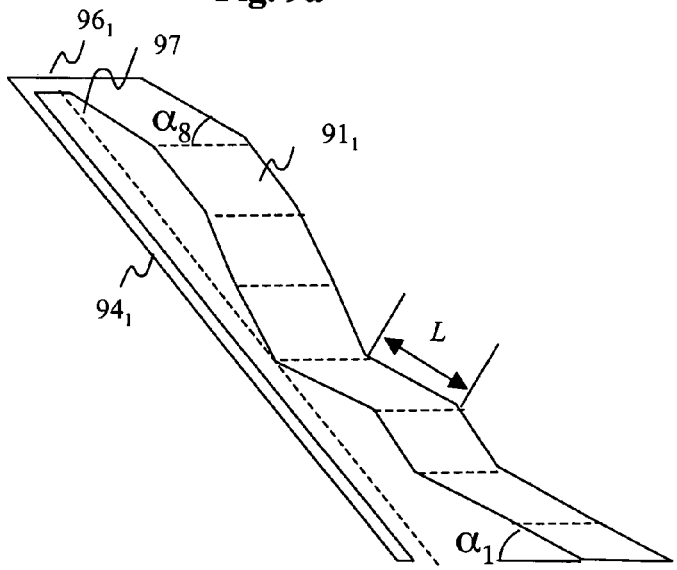

The radiating wires $\mathbf{91}_1$ and parasitic wires $\mathbf{94}_1$ and in particular the segments comprising the radiating wire $\mathbf{91}_1$ are shown in greater detail in FIG. 9*b*.

A PQH antenna 90 with a random variable pitch and reduced size is thus obtained.

Of course, depending on the needs, different constraints can be taken into account for optimisation.

Thus, a modification of the angles of wrap enables the axial length of the antenna PQH to be obtained, and the desired ellipticity ratio and coverage to be obtained.

According to FIG. 9*b*, the parasitic wire $\mathbf{94}_1$ is parallel to an internal tangent 97 (i.e. located between the radiating wire $\mathbf{91}_1$ and the associated parasitic wire $\mathbf{94}_1$) of the radiating wire $\mathbf{91}_1$.

According to an embodiment not shown, one or more parasitic wires are parallel to an external tangent (i.e. located on the side opposite the parasitic wire) of the associated radiating wire (thereby enabling the parasitic wire to be closer to an adjacent wire) or to a middle line of the associated radiating wire.

According to another embodiment not shown, one or more parasitic wires form a broken line. Preferably each of these parasitic wires comprises the same number of segments as the associated radiating wire and each segment of the parasitic wire has the same length and is parallel to a corresponding segment on the associated radiating wire (thus, in addition to a different width, the parasitic wire and the associated radiating wire have the same form), thereby enabling a parasitic wire to be positioned very close to an adjacent radiating wire.

According to yet another embodiment of the invention not shown, the parasitic wires of a helical antenna are connected by coupling (and not directly) with radiating wires forming a broken line similar to the connection by coupling shown in FIGS. 7*a* and 7*b*.

Many embodiments shown in FIGS. 3 to 9 can be envisaged.

In particular, it should be noted that the width of the parasitic wires can have any value less than that of an associated radiating wire and preferably of approximately one eighth that of an associated radiating wire.

Moreover, the invention can be applied to any type of helical antenna, and not only to quadrifilar antennas.

It is also possible that the wires are not all of identical sizes.

According to the embodiment described, the antenna is flat printed, then wound around a support to form the antenna. According to another faster embodiment, the substrate intended to receive the printed elements can be produced directly in its final cylindrical form. In this case, the printing of the wires and the power supply structure is carried out directly on the cylinder.

Furthermore, it should be noted that although it can be used as a single unit, the antenna of the invention is also suitable for producing antenna arrays.

It is also possible to have two (or more) antennas of this type coaxially and concentrically.

Finally, the technique of the invention is compatible with techniques for reducing the size of the antenna, such as, in particular, that proposed in the patent application in patent document FR-0011830, of France Telecom (helical antenna with variable pitch) or for increasing the bandwidth, for example, according to a technique proposed in patent document FR-0011843, of France Telecom (helical antenna with wires of variable width). In these different cases, the presence of a variable pitch and/or the variation in width can be applied to all wires, or selectively to some of them.

The invention claimed is:

1. Helical antenna including at least one helix formed by at least two radiating wires, each of them being connected by coupling to an associated parasitic wire by one first end, said radiating wires and parasitic wires being parallel and having a same length, wherein each of said parasitic wires is narrower than said associated radiating wire and the ratio between the width of each of said parasitic wires and the width of said associated radiating wire is less than or equal to 0.15, and wherein each of said parasitic wires is farther in a direction perpendicular to the axis of said parasitic wires from said associated radiating wire than from at least one of said other radiating wires.

2. Helical antenna according to claim 1, wherein said radiating wires and said at least one parasitic wire are printed on a substrate.

3. Helical antenna according to claim 2, wherein said radiating wires are printed on a first surface of a substrate and wherein said parasitic wires are printed on a second surface of said substrate.

4. Helical antenna according to claim 3, wherein at least one parasitic wire and one radiating wire adjacent to said radiating wire with which said parasitic wire is associated cross over one another.

5. Helical antenna according to claim 1, wherein each of said parasitic wires is connected to the ground.

6. Helical antenna according to claim 1, wherein one end of each of said parasitic wires is connected by a conductive connection to one of the ends of said radiating wire with which said parasitic wire is associated.

7. Helical antenna according to claim 6, wherein the end of said radiating wires not connected to a parasitic wire is connected to a feedline of a power supply circuit.

8. Helical antenna according to claim 1, wherein one end of each of said parasitic wires is connected by coupling to one of the ends of said radiating wire with which said parasitic wire is associated.

9. Helical antenna according to claim 1, wherein at least one of said helices is a quadrifilar helix, including four wires.

10. Helical antenna according to claim 1, wherein said radiating wires forming a helix are all the same size and in that said parasitic wires are all the same size.

11. Helical antenna according to claim 1, wherein at least one of said radiating and/or parasitic wires is formed by at least two segments, in which the angles of wrap of at least two of said segments are different and determined randomly or pseudo-randomly using global optimisation means.

12. Helical antenna according to claim 1, wherein at least one of said radiating and/or parasitic wires has a variable width, varying regularly and consistently between a maximum and a minimum width.

13. Helical antenna according to claim 1, wherein said radiating wires have a length substantially different from a multiple of the wavelength corresponding to the mean frequency of the transmission band of said antenna, divided by 4.

* * * * *